US005205954A

United States Patent [19]

Ahmed et al.

[11] Patent Number: 5,205,954

[45] Date of Patent: Apr. 27, 1993

[54] AUTOMATIC DISHWASHER POWDER DETERGENT COMPOSITION

[75] Inventors: Fahim U. Ahmed, Dayton; Charles E. Buck, West Caldwell, both of N.J.

[73] Assignee: Colgate-Palmolive Co., Piscataway, N.J.

[21] Appl. No.: 730,315

[22] Filed: Jul. 15, 1991

Related U.S. Application Data

[63] Continuation-in-part of Ser. No. 444,250, Dec. 1, 1989, abandoned, which is a continuation-in-part of Ser. No. 323,138, Mar. 19, 1989, Pat. No. 4,968,445, which is a continuation of Ser. No. 102,205, Sep. 19, 1987, abandoned, and a continuation-in-part of Ser. No. 323,136, Mar. 19, 1989, Pat. No. 4,889,653, which is a continuation of Ser. No. 113,562, Oct. 28, 1987, abandoned, and a continuation-in-part of Ser. No. 323,134, Mar. 19, 1989, Pat. No. 4,970,016, which is a continuation of Ser. No. 114,911, Oct. 30, 1987, abandoned, and a continuation-in-part of Ser. No. 323,137, Mar. 19, 1989, Pat. No. 4,968,446, which is a continuation of Ser. No. 117,184, Nov. 19, 1987, abandoned.

[51] Int. Cl.[5] ..... C11D 3/12; C11D 3/43; C11D 3/395; C11D 3/08

[52] U.S. Cl. ..... 252/99; 252/94; 252/135; 252/140; 252/174.14; 252/174.17; 252/174.18; 252/174.23; 252/174.14; 252/174.25

[58] Field of Search ..... 252/94, 99, 135, 140, 252/174.14, 174.17, 174.18, 174.23, 1274.24, 174.25

[56] References Cited

U.S. PATENT DOCUMENTS

| | | | |
|---|---|---|---|
| 3,579,455 | 5/1971 | Sabatelli et al. | 252/135 |
| 3,755,180 | 8/1973 | Austin | 252/95 |
| 3,933,672 | 1/1976 | Bartolotta | 252/174 |
| 3,985,668 | 10/1976 | Hartman | 252/99 |
| 4,051,056 | 7/1977 | Hartman | 252/99 |
| 4,116,851 | 9/1978 | Rupe et al. | 252/103 |
| 4,136,045 | 1/1979 | Gault et al. | 252/135 |
| 4,457,856 | 7/1984 | Mitchell et al. | 252/166 |
| 4,750,942 | 6/1988 | Van Dijk et al. | 252/142 |
| 4,889,653 | 12/1989 | Ahmed et al. | 252/DIG. 2 |
| 4,968,445 | 11/1990 | Ahmed et al. | 252/DIG. 14 |
| 4,970,016 | 11/1990 | Ahmed et al. | 252/99 |
| 5,094,771 | 3/1992 | Ahmed et al. | 252/104 |

FOREIGN PATENT DOCUMENTS 0186234 7/1986 European Pat. Off. .

*Primary Examiner*—Paul Lieberman
*Assistant Examiner*—William S. Parks
*Attorney, Agent, or Firm*—Richard E. Nanfeldt; Robert C. Sullivan; Murray Grill

[57] ABSTRACT

The application is directed to an automatic dishwasher powder detergent composition with improved anti-filming and anti-spotting properties and to a method of using the detergent composition. The detergent composition comprises silica anti-filming agent, a water soluble polyacrylate antispotting agent, inorganic builder salts, chlorine bleach and bleach-stable detergent. The compositions provide reduced filming and spotting on dishware, glassware, china and the like, particularly in hard water at low temperature. The powder compositions are dry, free flowing and are highly soluble and readily dispersed in the wash bath.

10 Claims, No Drawings

AUTOMATIC DISHWASHER POWDER DETERGENT COMPOSITION

RELATED APPLICATIONS

This application is a continuation in part of applicants' co-pending application Ser. No. 07/444,250, filed Dec. 1, 1989, now abandoned which in turn is a continuation-in-part of applicants' co-pending prior applications Ser. No. 323,138 filed Mar. 3, 1989 now U.S. Pat. No. 4,968,445, which is a file wrapper continuation of Ser. No. 102,205 filed Sep. 29, 1987 (abandoned); Ser. No. 323,136 filed Mar. 10, 1989, which is a file wrapper continuation of Ser. No. 113,562 filed Oct. 28, 1987 (abandoned); Ser. No. 323,134 filed Mar. 13, 1989, which is a file wrapper continuation of Ser. No. 114,911 filed Oct. 30, 1987 (abandoned); and Ser. No. 323,137 filed Mar. 13, 1989now U.S. Pat. No. 4,968,446 which is a file wrapper continuation of Ser. No. 117,184 filed Nov. 5, 1987 (abandoned) all of which are directed to aqueous automatic dishwasher detergent compositions containing an anti-filming agent or an antifilming agent and an anti-spotting agent. The applications Ser. Nos. 323,138, 323,126, 323,134 and 323,137 have been allowed. The application Ser. No. 323,136 issued as U.S. Pat. No. 4,889,653 on Dec. 26, 1989, and the application Ser. No. 323,134 issued as U.S. Pat. No. 4,970,016 on Nov. 6, 1990.

FIELD OF THE INVENTION

The present invention relates to an automatic dishwasher detergent composition having improved anti-filming properties. The present invention is particularly directed to a stable dry powder detergent composition containing an anti-filming agent for use in an automatic dishwasher to clean dishware, glassware and the like.

The present invention more particularly relates to a powder automatic dishwashing detergent composition with improved anti-filming and anti-spotting properties and to a method of using the detergent composition to clean dishware, glassware, china and the like. The dishwashing composition contains an anti-filming agent, or an anti-filming agent and poly acrylic acid polymer or salt as anti-filming and anti-spotting agents, inorganic builder salts, chlorine bleach and bleach stable detergent.

The detergent dishwashing composition of the present invention reduced filming and/or spotting on dishware, glassware, china and the like, particularly in hard water at low temperature.

More specifically, the invention relates to the use of a nonabrasive amount of small substantially water insoluble particles, e.g. silica, as an anti-filming agent and polyacrylic acid or salt polymer as an anti-spotting agent in powder dishwashing detergent compositions to reduce filming and/or spotting.

The detergent compositions do not require an added rinse aid, are stable in storage and are readily dispersible in wash bath.

The present invention specifically relates to powder automatic dishwashing detergent compositions having improved anti-filming and anti-spotting properties, which are readily dispersible in the washing medium to provide effective cleaning of dishware, glassware, china and the like.

The present invention also relates to an improved powder composition and to a method of using the composition.

BRIEF DESCRIPTION OF THE INVENTION

The present invention is directed to a powder automatic dishwasher detergent composition having improved anti-filming and/or anti-spotting properties for cleaning of dishware, glassware, china and the like. The detergent composition contains as an essential ingredient a nonabrasive amount of small substantially water insoluble solid particles as an anti-filming agent. The compositions can additionally contain a polyacrylic acid polymer or salt as an anti-spotting agent.

The present invention specifically relates to powder automatic dishwashing detergent powder compositions having improved anti-filming and/or anti-spotting properties for cleaning of dishware, glassware, china and the like.

The powder compositions are dry, free-flowing and readily dispersed in the wash bath.

PRIOR ART

Commercially available household-machine dishwasher detergents provided in powder or liquid form have many disadvantages.

Commercially available powder detergents have the disadvantages of non-uniform composition; costly operations necessary in their manufacture; tendency to cake in storage at high humidities, resulting in the formation of lumps which are difficult to disperse; dustiness, a source of particular irritation to users who suffer allergies; and tendency to cake in the dishwasher machine dispenser. Liquid forms of dishwashing compositions, however, generally cannot be used in automatic dishwashers due to high foam levels and unacceptably low viscosities.

In addition, the commercially available formulated powder detergents frequently require a separate step of hand towel wiping and drying of the dishware, glassware, china and the like to avoid leaving undesirable traces or film. The use of liquid detergent compositions present other problems. The builder salts settle in storage and are not readily redispersed. The compositions also frequently become thicker in storage and are not readily pourable.

For effective use, it is generally recommended that the automatic dishwashing detergent, hereinafter also designated ADD, contain (1) sodium tripolyphosphate (NaTPP) to soften or tie up hard-water minerals and to emulsify and/or peptize soil; (2) sodium silicate to supply the alkalinity necessary for effective detergency and to provide protection for dishware, such as fine china and protection against machine corrosion; (3) sodium carbonate, generally considered to be option, to enhance alkalinity; (4) a chlorine-releasing agent to aid in cleaning; (5) a surfactant and (6) a defoamer to reduce foam, thereby enhancing machine efficiency. See, for example, SDA Detergents in Depth, "Formulations Aspects of Machine Dishwashing," Thomas Oberle (1974). Cleansers approximating to the afore-described compositions are mostly liquids or powders. Generally, such compositions omit hypochlorite bleach, since it tends to react with other chemically active ingredients, particularly surfactant, thereby impairing its effectiveness.

Thus, U.S. Pat. No. 3,985,668 describes abrasive scouring cleaners of gel-like consistency containing (1)

suspending agent, preferably the Smectite and attapulgite types of clay; (2) abrasive, e.g. silica sand or perlite; and (3) filler comprising light density powdered polymers, expanded perlite and the like. The perlite has a buoyancy and thus stabilizing effect on the composition in addition to serving as a bulking agent, thereby replacing water otherwise available for undesired supernatant layer formation due to leaking and phase destabilization. The foregoing are the essential ingredients. Optional ingredients include hypochlorite bleach, bleach stable surfactant and buffer, e.g. silicates, carbonates, and monophosphates. Builders, such as NaTPP, can be included as further optional ingredients to supply or supplement building function not provided by the buffer, the amount of such builder not exceeding 5% of the total composition, according to the patent. Maintenance of the desired (greater than) pH 10 levels is achieved by the buffer/builder components. High pH is said to minimize decomposition of chlorine bleach and undesired interaction between surfactant and bleach. When present, NaTPP is limited to 5%, as stated. Foam killer is not disclosed.

U.S. Pat. No. 4,511,487 dated Apr. 16, 1985 describes a low-foaming detergent paste for dishwashers. The composition is based on a mixture of finely divided hydrated sodium metasilicate, an active chlorine compound and a thickening agent which is a foliated silicate of the hectorite type. Small amount of nonionic tensides and alkali metal carbonates and/or hydroxides may be used.

ADVANTAGES OVER THE PRIOR ART

The powder detergent compositions of the present invention overcome many of the prior art problems associated with powder and liquid detergents. Because of the addition of a small effective amount of a silica anti-filming agent or silica and polyacrylic acid polymer or salt anti-spotting agent to the composition on added rinse aid is not required to obtain dry sparkling clean dishes, glasses, cups and eating utensils.

The powder detergent composition has the additional advantages of being stable in storage and readily redispersible in the dishwashing machines. The powder compositions of the present invention are easily pourable, easily measured and easily put into the dishwashing machines.

An additional and unexpected advantage of adding the silica anti-filming agent to the detergent formulation is that the silica inhibits brown stain formation in the dishwashing machine. The brown stain is formed by the deposition in the dishwashing machine of iron and/or manganese oxides. The brown stain formation is a particularly serious problem in areas having hard water. The silica in the formulation acts on the iron and/or manganese in the wash water to prevent their deposition in the dishwashing machine as iron and/or manganese oxides.

The powder detergent compositions of the present invention are stable in storage, are readily dispersed and, with the exception of the anti-film agent, are easily soluble in the dishwashing machine.

OBJECTS OF THE PRESENT INVENTION

It is an object of the present invention to provide a powder automatic dishwasher detergent composition that has improved anti-filming and/or anti-spotting properties.

It is another object of the invention to provide a powder detergent composition which is stable in storage, does not degrade or decompose, is readily dispersible and is easily soluble in the dishwashing water.

A further object of the invention is to provide a method of washing dishware, glassware, china and the like in an automatic dishwashing machine using a powder detergent composition in which a separate rinse aid is not added or needed.

A still further object of the invention is to provide a method of washing dishware, glassware, china and the like in an automatic washing machine using a powder detergent composition by which method the dishware, glassware, china and the like are machine dried with reduced film, and spots.

It is a further object of this invention to provide stable dry powder detergent compositions, especially automatic dishwasher detergent compositions, by incorporating in the composition a small effective amount of a silica anti-filming agent or silica and polyacrylic acid polymer or salt as antifilming and anti-spotting agents.

DETAILED DESCRIPTION OF THE INVENTION

These and other objects of the invention which will become more readily understood from the following detailed description of the invention and preferred embodiments thereof are achieved by incorporating in a powder detergent composition a small but effective amount of a silica antifilming agent or silica anti-filming agent and polyacrylic acid polymer or salt anti-spotting agent. More particularly, according to a preferred and specific embodiment of the invention, there is provided a powder automatic dishwasher detergent composition in which is incorporated from about 0.5 to 5.0% of an anti-filming agent and/or 1 to 15% of a water soluble polyacrylic acid polymer or salt anti-spotting agent. The silica anti-filming agent has a particle size of about 0.75 to 10 microns. The water soluble polyacrylic acid or salt polymer has a molecular weight of about 1000 to 100,000.

In accordance with the present invention there is provided a dry powder automatic dishwasher detergent composition which includes, on a weight basis:

(a) 20 to 70% organic or inorganic builder salt;
(b) 5 to 40% sodium silicate;
(c) chlorine bleach compound in an amount to provide 0.5 to 8% available chlorine;
(d) 0.5 to 5.0% anti-filming agent;
(e) 1 to 15% polyacrylic acid polymer or salt;
(f) 0 to 30% alkali metal carbonate;
(g) 0.1 to 6% chlorine bleach stable, water dispersible organic detergent active material;
(h) 0 to 6% chlorine bleach stable foam depressant; and
(i) 0–30% sodium sulfate.

The present invention also provides a method for cleaning dishware, glassware, china and the like in an automatic dishwashing machine with an aqueous wash bath containing an effective amount of the automatic dishwasher detergent (ADD) powder composition as described above. According to this aspect of the invention, the ADD composition is a dry, free flowing powder and can be readily poured into the dispensing cup of the automatic dishwashing machine and will remain within the dispensing cup until subjected to the water spray from the dishwashing machine.

The invention will now be described in greater detail by way of specific embodiments thereof.

In accordance with the present invention an improved automatic dishwasher detergent composition is prepared by incorporating small amounts of an anti-filming agent and/or polyacrylic acid polymer or salt anti-spotting agent in a dishwasher composition.

The present invention is based upon the discovery that substantially improved anti-filming and/or anti-spotting properties can be obtained by adding to the powder detergent composition a small effective amount of an anti-filming agent and/or polyacrylic acid polymer or salt anti-spotting agent.

ANTI-FILMING AGENTS

The anti-filming agent comprises a nonabrasive amount of small substantially water insoluble particles. The anti-filming agent can be a member selected from the group consisting of silica, alumina and titanium dioxide and mixtures thereof.

Silica

The silica anti-filming agent materials that can be used are fumed or precipitated synthetica or natural silica. The silica may be amorphous or crystalline.

The silica material that is used may contain up to about 0.1 to 2.5% alumina ($Al_2O_3$), usually up to about 0.5 to 2.0% and more usually about 1% alumina, based on the weight of silica.

A preferred silica material is Syloid 244 which is amorphous silica, has a particle size of about 3 microns and is provided by W. R. Grace Co. Another suitable silica material is Silox 15, also from W. R. Grace Co., which has a particle size of about 4 microns.

Another preferred silica material is Huber Zeo 49 which is amorphous silica and is provided by J. M. Huber Corporation and contains about 1% alumina ($Al_2O_3$). The present of as little as 1% $Al_2O_3$ is found to help reduce the hydrolysis and subsequent solubility of the silica in the highly alkaline automatic dishwashing detergent composition.

The particle size of the silica material that is used is important in achieving the desired anti-filming properties.

The silica particles that are used are finely divided and can have a particle size of about 0.75 to 5.0 microns, preferably 0.75 to 3.0 microns and more preferably about 0.75 to 2.0 microns. The silica particles of this size and the amount used herein are not abrasive. Especially preferred silicas have a particle size of 0.75 to 1.5 microns.

The finely divided silica material particles in the dishwashing wash act to coagulate proteinaceous particulate soils and keeps them in suspension to prevent them from depositing on the clean glass and dishware to form a film.

The amount of silica anti-filming agent that can be used to achieve the desired improvement in film will depend on the hardness of the water, detergent active compound, inorganic salts and other ADD ingredients. The silica anti-filming agents are particularly effective in hard wash water of, for example, 300 ppm hardness or more.

The amount of the silica anti-film agent that is used can be about 0.1 to 5.0%, preferably about 0.5 to 3.0% and more preferably about 0.5 to 2.0% by weight based on the weight of the entire composition.

ANTI-SPOTTING AGENTS

Polyacrylic Acid Polymers and Salts Thereof

The polyacrylic acid polymers and salts thereof anti-spotting agents that can be used are generally commercially available and are briefly described as follows.

The polyacrylic acid polymers and salts thereof that can be used comprise water soluble low molecular weight polymers having the formula

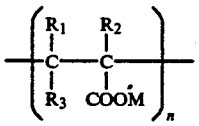

wherein the $R_1$, $R_2$ and $R_3$ can be the same or different and can be hydrogen, $C_1$–$C_4$ lower alkyl, or combinations thereof. The value of n is 5 to 1000, preferably 10 to 500, and more preferably 20 to 100. M represents hydrogen, or an alkali metal such as sodium or potassium. The preferred substituent for M is sodium.

The preferred $R_1$, $R_2$ and $R_3$ groups are hydrogen, methyl, ethyl and propyl. Preferred acrylic acid monomer is one where $R_1$ to $R_3$ are hydrogen, e.g. acrylic acid, or where $R_1$ and $R_3$ are hydrogen and $R_2$ is methyl, e.g. methyl acrylic acid monomer.

The degree of polymerization, i.e. The value of n, is generally determined by the limit compatible with the solubility of the polymer in water. The terminal or end groups of the polymer are not critical and can be H, OH, $Ch_3$ or a low molecular weight hydrocarbon.

The polyacrylic acid polymers and salts thereof can have a molecular weight of 500 or 1,000 to 100,000, preferably 1,500 to 80,000 and especially preferably 2,000 to 50,000.

Specific polyacrylic acid polymers which can be used include the Acrysol LMW acrylic acid polymers from Rohm and Haas, such as the Acrysol LMW-45N, a neutralized sodium salt, which has a molecular weight of about 4,500 and Acrysol LMW-20NX, a neutralized sodium salt, which has a molecular weight of about 2,000. Other polyacrylic acid polymers or salts thereof that can be used are: Alcosperse 149, molecular weight 2000, Alcosperse 123, molecular weight 4500, Alcosperse 107, molecular weight 3000, Alcosperse 124, molecular weight 2000, and Alcosperse 602N molecular weight 4500, all of which are available from Alco Chemical Corp. The low molecular weight acrylic acid polymers can, for example, have a molecular weight of about 1,000 to 10,000. Another polyacrylic acid polymer that can be used is Alcosperse 110 (from Alco) which is a sodium salt of an organic polycarboxylate and which has a molecular weight of about 100,000.

The above polyacrylic acid polymers and salts thereof can be made using procedures known in the art, see for example U.S. Pat. No. 4,203,858.

The amount of polyacrylic acid polymer or salt that can be used to achieve the desired improvement in anti-filming and anti-spotting properties will depend on the hardness of the water, detergent active compound, inorganic salts and other ADD ingredients.

The polyacrylic acid or salt anti-spotting agent is particularly effective in reducing spotting in hard water of, for example, 300 ppm hardness or more.

Generally, the amounts of the polyacrylic acid polymer or salt anti-spotting agent that can be used are in the range of from about 1.0 to 15%, preferably from about 2.0 to 12%, especially preferably about 4 to 10%.

BUILDER SALTS

Generally, ADD effectiveness is directly related to (a) available chlorine levels; (b) alkalinity; (c) solubility in washing medium; and (d) foam inhibition. It is preferred herein that the pH of the ADD composition be at least about 9.5, more preferably from about 10.5 to 13.5 and most preferably at least about 11.5

The amount of alkali metal silicate added and the amount of alkali metal TPP added can be used to obtain the desired alkalinity. The sodium carbonate can be added to act as a buffer to maintain the desired pH level in the wash bath. The sodium carbonate can be added in an amount of 0 to 30 wt. %, preferably 5 to 25 wt. % and typically about 8 to 20 wt. % of the detergent composition. The sodium carbonate can be added for example in an amount of 15 to 20 wt. %.

The compositions of the present invention can contain inorganic builder salts such as NaTPP or organic builder salts such as the alkali metal salts of citric and tartaric acid.

A preferred solid builder salt is an alkali metal polyphosphate such as sodium tripolyphosphate ("TPP"). In place of all or part of the alkali metal polyphosphate one or more other detergent builder salts can be used. Suitable other builder salts are alkali metal borates, phosphates and bicarbonates.

Specific examples of such builders are sodium tetraborate, sodium pyrophosphate, potassium pyrophosphate, sodium bicarbonate, sodium hexametaphosphate, sodium sesquicarbonate, sodium mono and diorthophosphate and potassium bicarbonate.

The NaTPP may be employed in the ADD composition in a range of 20 to 70%, preferably about 20 to 60 wt. %, and more preferably about 25 to 45 wt. %, for example 20 to 40$. The NaTPP may be anhydrous or hydrated, including the stable hexahydrate with a degree of hydration of 6 corresponding to about 18% by weight of water or more.

Since the compositions of this invention are generally highly concentrated, and, therefore, may be used at relatively low dosages, it is desirable to supplement any phosphate builder (such as sodium tripolyphosphate) with an auxiliary builder such as an alkali metal polycarboxylic acid. The NaTPP may be replaced in whole or in part by the alkali metal polycarboxylic acid. Suitable alkali metal polycarboxylic acids are alkali metal salts of citric and tartaric acid, e.g. monosodium and disodium citrate (anhydrous). The sodium salts of citric and tartaric acids are preferred.

Alkali metal sulfates, preferably sodium sulfate is added as an anhydrous filler material. The sodium sulfate can be added in an amount of 0–30%, preferably 5 to 25%, and more preferably 10 to 20% by weight of the composition.

Foam Inhibitors

Foam inhibitation is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somewhat dependent on the hardness of the wash water in the machine whereby suitable adjustment of the proportions of NaTPP which has a water softening effect may aid in providing the desired degree of foam inhibition. However, it is generally preferred to include a chlorine bleach stable foam depressant or inhibitor. Particularly effective are the alkyl phosphonic acid esters of the formula

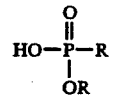

available, for example from BASF-Wyandotte (PCUK-PAE), and especially the alkyl acid phosphate esters of the formula

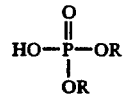

available, for example, from Hooker (SAP) and Knapsack (LPKN-158), in which one or both R groups in each type of ester may represent independently $C_{12-20}$ aklyl group. Mixtures of the two types, or any other chlorine bleach stable types, or mixtures of mono- and di-esters of the same type, may be employed. Especially preferred is a mixture of mono- and di-$C_{16-18}$ alkyl acid phosphate esters such as monostearyl/distearyl acid phosphates 1.2/1 (Knapsack). When employed, proportions of 0.01 to 6 wt. %, preferably 0.1 to 5 wt. %, especially about 0.1 to 0.5 wt. %, of foam depressant in the composition is typical. The weight ratio of detergent active component to foam depressant generally ranging from about 15:1 to 2:1 and preferably about 10:1 to 4:1. Other defoamers which may be used include, for example, the known silicones.

Although any chlorine bleach compound may be employed in the compositions of this invention, such as sodium hypochlorite and calcium hypochlorite, sodium dichloro-isocyanurate, dichloro-dimethyl hydantoin, and chlorinated TSP, sodium dichloro-isocyanurate is preferred. The composition should contain sufficient chlorine bleach compound to provide about 0.5 to 8.0% by weight of available chlorine, as determined, for example, by acidification of the composition with sulfuric acid. A solution containing about 0.9 to 14.3% by weight of sodium dichloroisocyanurate contains or provides roughly the same percentage of available chlorine. The composition can preferably contain about 1 to 3% available chlorine. For example, a solution containing about 1.8 to 5.4% by weight sodium dichloroisocyanurate dihydrate contains about 1 to 3% by weight of available chlorine and is especially preferred.

The sodium silicate, which provides alkalinity and protection of hard surfaces, such as fine china, is employed in an amount ranging from about 5 to 40 wt. %, preferably about 8 to 35 wt. %, and more preferably about 10 to 25 wt. %, in the composition. For example the composition can contain 8 to 25% sodium silicate. The sodium silicate also protects the washing machine from corrosion. The sodium silicate also protects the washing machine from corrosion. The sodium silicate can have a $Na_2O:SiO_2$ ratio of 1.6/1 to 1/3.2. The sodium silicate can be added in the form of a dry powder or an aqueous solution, preferably having an $Na_2O:SiO_2$ ratio of from 1/1 to 1/2.8, for example, 1/2.4.

Potassium silicates of the same ratios can also be used. The preferred alkali metal silicates are sodium disilicate and sodium metasilicate.

Most of the other components of the composition, especially calcium hypochlorite and foam depressant can be added in the form of dry powders or aqueous dispersions or solutions.

The detergent active materials used in the present invention are selected to be stable in the presence of chlorine bleach. The organic nonionic and anionic detergents can be used.

Liquid Nonionic Surfactant Detergents

The liquid nonionic surfactant detergents that can be used in the practice of the present are preferably the low foam nonionic surfactants.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include a $C_{13}$–$C_{15}$ fatty alcohol condensed with 6 moles 1 ethylene oxide and 3 moles propylene oxide, a $C_{13}$–$C_{15}$ fatty alcohol condensed with 7 moles propylene oxide and 4 moles ethylene oxide and a $C_{13}$–$C_{15}$ fatty alcohol condensed with 5 moles propylene oxide and 10 moles ethylene oxide.

Other useful surfactants are Neodol 25-7 and Neodol 25-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

A preferred nonionic surfactant is available from Union Carbide Corporation under the trademark Tergitol MDS-42. This nonionic surfactant is a $C_{12}$–$C_{14}$ linear alcohol containing 55% by weight random distributed oxyalkyl groups of which 42% are ethoxy and 58% propoxy groups.

Another nonionic surfactant that can be used in accordance with the present invention has the following formula $$R—O—(PO)_x—(EO/PO)H$$

R is an alkyl group having 8 carbon atoms, PO is a propylene oxide polymer attached directly to the oxygen of the alkyl group, x is 8 to 9, EO/PO represents a copolymer of ethylene oxide and propylene oxide in which the ethylene oxide and propylene oxide are randomly mixed. The molar ratio of EO/PO is about 2:1 to 5:1, e.g. about 3:1. The total number of EO and PO groups in the copolymer are such that the number of EO and PO groups are 5 to 8 and the cloud point of the nonionic surfactant is about 20° to 30° C.

A method of making the nonionic surfactant and a more complete description of the nonionic surfactant is given in the EPA published patent application 0086493 dated Aug. 24, 1983 which is incorporated herein in its entirety.

Other useful nonionic surfactants are the Poly-Tergent S-LF surfactants available from Olin Corporation. These surfactants are low foaming, biodegradable linear fatty alcohols. Surfactants of this type are available under the tradenames Poly-Tergent S-LF 18, Poly-Tergent S-305-LF, Poly-Tergent S-405-LF and Poly-Tergent CS-1.

Mixtures of two or more of the liquid nonionic surfactants can be used and in some cases advantages can be obtained by the use of such mixtures.

The detergent active materials used herein must be stable in the presence of chlorine bleach, especially hypochlorite bleach. In addition to the above discussed nonionic surfactants, anionic surfactants can also be used.

Anionic Surfactants

The anionic surfactants that can be used are the linear or branched alkali metal mono- and/or di-($C_{8-14}$) alkyl diphenyl oxide mono and/or disulphonates, commercially available for example as DOWFAX (Registered Trademark) 3B-2 and DOWFAX 2A-1.

Other suitable surfactants include the primary alkyl sulphates, alkyl sulphonates, alkylaryl-sulphates and sec. alkyl sulphates. Examples include sodium $C_{10-18}$ alkyl sulphates such as sodium dodecyl sulphate and sodium tallow alcohol sulphate; sodium $C_{10-18}$ alkane sulphonates such as sodium hexadecyl-i-sulphonate and sodium $C_{12-18}$ alkylbenzene sulphonates such as sodium dodecylbenzene sulphonates. The corresponding potassium salts may also be employed.

Surfactants of the foregoing type, all well known in the art, are described, for example, in U.S. Pat. Nos. 3,985,668 and 4,271,030, which are incorporated herein by reference thereto.

The surfactants are used in amounts of 0.1 to 6%, preferably 0.5 to 6.0%, and more preferably about 1.0 to 5.0%, for example 2 to 4%.

Various conventional ingredients may be included in these compositions in small amounts, generally less than about 4 wt. %, such as perfume, hydrotropic agents such as the sodium benzene, toluene, xylene and cumene sulphonates, preservatives, dyestuffs and pigments and the like, all of course being stable to chlorine bleach compound and high alkalinity. Especially preferred for coloring are the chlorinated phthalocyanines and polysulphides of aluminosilicate which provide, respectively, pleasing green and blue tints.

The powder ADD compositions of this invention are readily employed in known manner for washing dishes, glasses, cups, eating utensils and the like in an automatic dishwasher, provided with a suitable detergent dispenser, in an aqueous wash bath containing an effective amount of the composition.

In am embodiment of the invention a powder automatic dishwashing detergent composition is formulated using the below named ingredients.

| Component | Weight Percent | Preferred Weight Percent |
|---|---|---|
| Sodium Tripolyphosphate | 20–60 | 20–40 |
| Sodium Carbonate | 0–30 | 8–20 |
| Sodium Sulfate | 0–30 | 10–20 |
| Surfactant | 0.5–6 | 1–5 |
| Sodium Silicate | 8–35 | 8–25 |

-continued

| Component | Weight Percent | Preferred Weight Percent |
|---|---|---|
| Silica Anti-filming Agent | 0.1-5.0 | 0.5-3 |
| Sodium Polyacrylate Anti-spotting Agent | 1-15 | 4-10 |
| Sodium Dichloroisocyanurate (Available Chlorine) | 0.5-5 | 1.0-3.0 |
| Color Perfume | 0.5-3.0 | 1-2 |
| Moisture | 2-14 | 8-10 |

The powder detergent composition can be prepared as a regular strength composition containing sodium carbonate and sodium sulfate or as a concentrate composition in which all or a portion of each of the sodium carbonate and sodium sulfate have been omitted.

The dishwasher detergent compositions of the present invention can contain conventional dishwashing detergent composition additives. The formulations can be prepared with commercially available powder builders, chlorine bleach source compounds and surfactant compounds.

The formulations can be prepared using the conventional dry blending and agglomeration procedures used for the preparation of dry powder detergent compositions.

In dry the blending procedure, nonionic surfactant is thoroughly mixed with STPP by overspraying it at 120° F. in a twin-shelled mixer. The STPP beads containing absorbed surfactant are then conditioned, that is allowed to sit overnight. The loaded STPP material is then successively mixed with anti-filming agent or anti-filming agent and polyacrylate acid polymer or salt, sodium carbonate, sodium sulfate and sodium silicate granules. Finally sodium dichloroisocyanurate is added and blended with the rest and mixed thoroughly in the mixer.

Another method for preparing the automatic dishwasher detergent powder compositions of the present invention is the agglomeration procedure. The agglomeration procedure provides better bleach stability by coating the nonionic surfactant with the sodium silicate which separates the nonionic surfactant from the reactive bleach.

In accordance with the agglomeration procedure, about half of the STPP builder salt in the form of powder granules is introduced into a rotary drum and sprayed with the nonionic liquid surfactant at a temperature of about 120° F. The STPP granules during the spraying operation are maintained at a temperature of about 100° F.

The STPP granules loaded with the nonionic surfactant are dried overnight. The loaded dried STPP is mixed with the remaining STPP, anti-filming agent or anti-filming agent and polyacrylic acid or salt, sodium carbonate and sodium sulfate in an agglomerator.

An aqueous solution of sodium silicate is then sprayed on the mixed powders in the agglomerator.

The mixed agglomerated powders are then added to a granulator in order to sieve out the desired particle size of the agglomerate. From the granulator the powder composition is fed to a fluid bed drying unit to dry the powder. Finally, sodium dichloroisocyanurate is post added and blended with agglomerated granules to complete the process.

One or more ingredients can be omitted or additional ingredients such as perfumes and anti-foam agents can be added to the composition.

The order of adding the solid powder ingredients to the agglomerator is not particularly critical as long as good mixing is achieved.

The term dry powder compositions as used herein is intended to include free flowing powder compositions containing 0-15% moisture, typically 2-14% and more typically 4-12% moisture, for example 8-10%. The moisture can be present in the form of hydrated compounds, for example, sodium tripolyphosphate hexahydrate, hydrated sodium carbonate, hydrated sodium sulfate and dichloroisocyanurate dihydrate and/or in the form of unbound water. It is preferred that the composition contain less than about 10% moisture as unbound water.

All amounts and proportions referred to herein are percent by weight of the composition unless otherwise indicated.

The invention may be put into practice in various ways and a number of specific embodiments will be described to illustrate the invention with reference to the accompanying examples.

EXAMPLE 1

In accordance with the present invention automatic dishwasher powder detergent compositions are formulated using the below named ingredients in the amounts indicated.

| Ingredient | A Invention Powder (wt. %) | B Prior Art Commercial Powder (wt. %) |
|---|---|---|
| Sodium Tripolyphosphate | 34.8 | 34.8 |
| Sodium Carbonate | 19.0 | 19.0 |
| Sodium Sulfate | 19.0 | 21.5 |
| Nonionic Surfactant[1] | 3.0 | 3.0 |
| Sodium Silicate (1:2.4) | 12.0 | 12.0 |
| Silica Anti-filming Agent | 2.5 | — |
| Sodium Dichloroisocyanurate Dihydrate[2] | 1.8 | 1.8 |
| Moisture | 7.9 | 7.9 |
| | 100.0 | 100.0 |

[1]Tergitol MDS-42, from Union Carbide Corporation.
[2]ACI 56, 1% available chlorine, Monsanto Corporation.

The two above formulations (A) and (B) are tested and compared for film and spot formation. The formulations are tested in a Kenmore automatic dishwasher using the procedure described in ASTMD 3566-79, except that only four cleaning cycles are used. The filming and spotting are evaluated according to the following scales:

Film Rating Scale

1. Best, no apparent film
2. Filming slight, becoming apparent
3. Noticeable film, increasing
4. Continued increase of significant film
5. Filming becoming excessive
6. Filming high, excessive buildup
7. Continued increase of excessive film

Spot Rating Scale

A. Best - no spots
B. Very few spots apparent
C. Distinct
D. Significant coverage approximately 50%

The above compositions are tested cleaning glass tumblers.

The ASTM Method D3556-79 for the deposition on glassware during mechanical dishwashing, as mentioned above, is used to evaluate the buildup of spots and film on glassware. 50 grams of the invention powder detergent composition (A) and 50 grams of the commercial powder detergent composition (B) detergent are used in each test. All testing reported is done in Kenmore Model 587.1548580 and/or model 587.1546580 Automatic Dishwasher. The water wash temperature is 120° F. and the water has 300 ppm hardness.

The results obtained in the fourth cycle are reported below.

| Formulation | Spot | Film |
|---|---|---|
| Invention Formulation (A) | B-C | 1-2 |
| Commercial Formulation (B) | B-C | 4-5 |

The commercial powder gives more film than the invention powder ADD compositions. There is no difference in the spot scores.

EXAMPLE 2

Following the teachings of the present invention powder automatic dishwasher detergent compositions are formulated using the below named ingredients in the amounts indicated.

In order to demonstrate the improvement in anti-filming and anti-spotting performance three powder formulations are prepared. The first formulation (A) contains 2.24 wt. % silica anti-filming agent, the second formulation (B) contains 2.24 wt. % silica anti-filming agent and 8 wt. % sodium polyacrylate and the third formulation (C) contains no silica and no sodium polyacrylate.

| | Formulations | | |
|---|---|---|---|
| | A wt. % | B wt. % | C wt. % |
| NaTPP[1] | 34.50 | 34.50 | 34.50 |
| Sodium Sulfate | 18.86 | 10.86 | 21.10 |
| Sodium Carbonate | 17.90 | 17.90 | 17.90 |
| Sodium Silicate | 10.00 | 10.00 | 10.00 |
| Nonionic Surfactant[2] | 3.10 | 3.10 | 3.10 |
| Silica Anti-filming Agent[3] | 2.24 | 2.24 | — |
| Na Polyacrylate[4] | — | 8.00 | — |
| Sodium Dichloroisocyanurate Dihydrate[5] | 1.80 | 1.80 | 1.80 |
| Moisture | 11.60 | 11.60 | 11.60 |
| | 100.00 | 100.00 | 100.00 |

[1]The NaTPP contains a minor amount of Na pyrophosphate and a minor amount of Na orthophosphate.
[2]The nonionic surfactant is Tergitol MDS-42.
[3]The silica anti-filming agent is Syloid 244 silica.
[4]The water soluble Na polyacrylate agent is Alcosperse 149-D 2000 MW.
[5]ACl 56, 1 wt. % available chlorine.

A dose size of 50 grams of each of formulations (A), (B) and (C) are used to evaluate the efficacy of the anti-filming and anti-spotting agents.

the invention formulations (A) and (B) are evaluated with regard to film and spot against the commercial formulation (C) under 300 ppm water hardness in 4 cycle ASTM runs at 120° F. water wash temperature in each test.

There are 10 glass tumblers used in each test. All three products are tested in the same GE dishwasher to minimize the machine effect. The results obtained in each of the tests are reported below.

| Performance Profile ASTM Test 300 ppm hard water, 120° F. | | | | | | |
|---|---|---|---|---|---|---|
| Glass Tumblers Average Value (C) | Invention Formulation (A) | | Invention Formulation (B) | | Commercial Formulation | |
| of 10 Tumblers | Spot | Film | Spot | Film | Spot | Film |
| 1 Cycle | B | 1 | A | 1 | B | 3 |
| 2 Cycle | B | 1.5 | A | 1.5 | B-C | 3.5 |
| 3 Cycle | B-C | 2 | A-B | 2 | B-C | 4 |
| 4 Cycle | B-C | 2-2.5 | A-B | 2-2.5 | B-C | 4-5 |

The invention formulation (a) performs better than commercial formulation (c) with regard to film formation. The invention formula (B) performs better than invention formulation (A) with regard to spot formation and better than commercial formulation (C) with regard to spot and film formation.

The above mentioned three products are also tested using 6 Melamine plates in each test.

The results obtained in each of the tests are reported below.

| Performance Profile ASTM Test 300 ppm hard water, 120° F. | | | | | | |
|---|---|---|---|---|---|---|
| Melamine Plates, Average (C) | Invention Formulation (A) | | Invention Formulation (B) | | Commercial Formulation | |
| Value 6 Plates | Spot | Film | Spot | Film | Spot | Film |
| 1 Cycle | A-B | 1 | A | 1 | A-B | 1 |
| 2 Cycle | A-B | 1 | A | 1 | B | 1 |
| 3 Cycle | A-B | 1 | A-B | 1 | B | 1 |
| 4 Cycle | A-B | 1 | A-B | 1 | B-C | 1 |

All three of the formulations gave no film. The inventive formulations (A) and (B) both performed substantially better against the commercial formulation (C) with regard to spot formation. The invention formulation (A) containing silica did not perform quite as well as invention formulation (B) containing silica and sodium polyacrylate with regard to spot formation.

The above data show that the addition of silica antifilming agent or silica and polyacrylate anti-filming agents give improved performance against filming on glassware and dishware.

EXAMPLE 3

Following the teachings of the invention a concentrate automatic dishwasher powder detergent composition is formulated using the below named ingredients.

| Ingredient | Weight Percent |
|---|---|
| Sodium Citrate Builder Salt | 50.0 |
| Sodium Carbonate | — |
| Sodium Sulfate | — |
| Nonionic Surfactant | 4.0 |
| Sodium Silicate (1:2.4) | 18.0 |
| Silica Anti-filming Agent[1] | 5.0 |
| Na Polyacrylate Anti-filming Agent[2] | 16.0 |
| Sodium Dichloroisocyanurate Dihydrate[3] | 2.8 |
| Moisture | 4.2 |
| | 100.0 |

[1]Syloid 244 Silica
[2]Alcosperse 149-D
[3]ACl 56, 1.6% available chlorine

About 28 grams of the above concentrated formulation, i.e. about one half the normal dose, is tested in an automatic dishwasher machine to clean glass tumblers.

The tumblers after a normal wash cycle are removed from the dishwasher and are found to be free of spots and to contain only a slight amount of film.

What is claimed is:

1. An automatic dishwasher powder detergent composition comprising approximately by weight:

(a) 20 to 70% inorganic or organic detergent builder salt, said inorganic or organic detergent builder salt being selected from the group consisting essentially of alkali metal polyphosphates, alkali metal borates, alkali metal carbonates, alkali metal bicarbonates, alkali metal citrates and alkali metal tartarates and mixtures thereof;

(b) 5 to 40% alkali metal silicate;

(c) 0 to 30% alkali metal carbonate;

(c) 0.1 to 6% chlorine bleach stable, water-dispersible organic detergent active material;

(e) 0 to 6% chlorine bleach stable foam depressant;

(f) chlorine bleach compound in an amount sufficient to provide about 0.5 to 8% of available chlorine; and (g) 0.5 to 3% of a nonabrasive silica anti-filming agent having a particle size of 0.75 to 3.0 microns.

2. The composition of claim 1 wherein the chlorine bleach compound is a member selected from the group of chlorocyanurates, dichloroisocyanurates, trichloroisocyanurates, and alkali and alkaline earth hypochlorites.

3. The composition of claim 1 additionally comprising 2 to 14% of a water soluble polyacrylic acid polymer or salt anti-spotting agent.

4. An automatic dishwasher powder detergent composition comprising approximately by weight:

(a) 20 to 60% alkali metal tripolyphosphate;

(b) 8 to 35% sodium silicate;

(c) 5 to 25 alkali metal carbonate;

(d) 0.5 to 6% chlorine bleach stable, water dispersible organic nonionic detergent active material;

(e) 0.1 to 5% chlorine bleach stable foam depressant;

(f) chlorine bleach compound in an amount sufficient to provide about 0.5 to 5% of available chlorine;

(g) a 0.5 to 2.0% amount of a nonabrasive silica anti-filming agent having a particle size of 0.75 to 1.5 microns; and (h) 0 to 12% moisture.

5. The composition of claim 4 additionally comprising 2 to 14% of a polyacrylic acid polymer or salt anti-spotting agent which has the formula

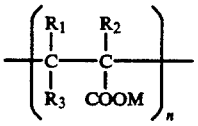

wherein the $R_1$, $R_2$ and $R_3$ can be the same or different and can be hydrogen, $C_1$–$C_4$ lower alkyl, M represents hydrogen, or an alkali metal, n=5 to 1000 and the polymer has a molecular weight of 1500 to 80,000.

6. The composition of claim 4 wherein the chlorine compound is sodium dichloroisocyanurate or sodium trichloroisocyanurate or mixtures thereof.

7. An automatic dishwasher powder detergent composition according to claim 1, wherein said silica is amorphous.

8. An automatic dishwasher powder detergent composition according to claim 4, wherein said silica is amorphous.

9. An automatic dishwasher powder detergent composition according to claim 1, wherein said composition contains less than about 10 wt. percent of moisture.

10. An automatic dishwasher powder detergent composition according to claim 4, wherein said composition contains less than about 10 wt. percent of moisture.

* * * * *